US012414614B2

(12) United States Patent
Zhao et al.

(10) Patent No.: US 12,414,614 B2
(45) Date of Patent: Sep. 16, 2025

(54) WRISTBAND AND WRIST-WORN DEVICE

(71) Applicant: GOERTEK INC., Weifang (CN)

(72) Inventors: Cheng Zhao, Weifang (CN); Jianning Zhang, Weifang (CN); Qingru Shao, Weifang (CN); Huaying Feng, Weifang (CN)

(73) Assignee: GOERTEK INC., Weifang (CN)

( * ) Notice: Subject to any disclaimer, the term of this patent is extended or adjusted under 35 U.S.C. 154(b) by 64 days.

(21) Appl. No.: 18/405,136

(22) Filed: Jan. 5, 2024

(65) Prior Publication Data

US 2024/0130485 A1 Apr. 25, 2024
US 2024/0225210 A9 Jul. 11, 2024

Related U.S. Application Data

(63) Continuation of application No. PCT/CN2021/126313, filed on Oct. 26, 2021.

(30) Foreign Application Priority Data

Jul. 6, 2021 (CN) ..... 202110759322.4

(51) Int. Cl.
*A44C 5/00* (2006.01)
*A44C 5/20* (2006.01)

(52) U.S. Cl.
CPC ..... *A44C 5/2071* (2013.01); *A44C 5/0061* (2013.01)

(58) Field of Classification Search
CPC ..... A44C 5/0061; A44C 5/2071; A44C 5/147; A44C 5/12; A44C 5/00; A44C 5/0053; A44C 5/185; A44C 5/14; Y10T 24/47; Y10T 24/4718
See application file for complete search history.

(56) References Cited

U.S. PATENT DOCUMENTS 6,234,667 B1 5/2001 Longman
2013/0298317 A1 11/2013 Fonte et al.
2015/0103638 A1 4/2015 Leung

FOREIGN PATENT DOCUMENTS

CH 334752 A * 12/1958
CH 518696 A * 2/1972
CN 201073040 Y 6/2008
(Continued)

OTHER PUBLICATIONS

First Office Action in Corresponding Chinese Application No. 202110759322.4, dated Aug. 26, 2022; 17 pgs.
(Continued)

*Primary Examiner* — Jack W Lavinder
(74) *Attorney, Agent, or Firm* — HAUPTMAN HAM, LLP

(57) ABSTRACT

Disclosed are a wristband and a wrist-worn device. The wristband includes a band body part and a memory metal wire. The band body part has two end portions separable from each other. The memory metal wire has a strip shape extending along a length direction of the band body part and provided to the band body part. The memory metal wire has a memory state of being ring-shaped in a natural state, so that the band body part naturally maintains a ring shape, and the wristband naturally maintains a wearing state. A first installation cavity is provided inside the band body part, and the memory metal wire is accommodated and installed in the first installation cavity.

8 Claims, 7 Drawing Sheets

(56) References Cited

FOREIGN PATENT DOCUMENTS

| | | | |
|---|---|---|---|
| CN | 203986448 | U | 12/2014 |
| CN | 204631448 | U | 9/2015 |
| CN | 105794223 | A | 7/2016 |
| CN | 206499033 | U | 9/2017 |
| CN | 206699578 | U | 12/2017 |
| CN | 207020576 | U | 2/2018 |
| CN | 208523936 | U | 2/2019 |
| CN | 110150803 | A | 8/2019 |
| CN | 209528089 | U | 10/2019 |
| CN | 110547568 | A | 12/2019 |
| CN | 209711778 | U | 12/2019 |
| CN | 210076761 | U | 2/2020 |
| CN | 212697930 | U | 3/2021 |
| CN | 213096516 | U | 5/2021 |
| CN | 113425050 | A | 9/2021 |
| CN | 113475828 | A | 10/2021 |
| CN | 215837436 | U | 2/2022 |
| JP | H01262803 | A | 10/1989 |
| JP | H11239506 | A | 9/1999 |
| JP | 2000300313 | A | 10/2000 |
| KR | 20160080313 | A | 7/2016 |
| TW | M579909 | U | 7/2019 |

OTHER PUBLICATIONS

International Search Report and Written Opinion in Corresponding International Application No. PCT/CN2021/126313, mailed Mar. 21, 2022; 15 pgs.

Notice to Grant in Corresponding Chinese Application No. 202110759322.4, dated Jan. 13, 2023; 5 pgs.

* cited by examiner

WRISTBAND AND WRIST-WORN DEVICE

CROSS-REFERENCE TO RELATED APPLICATIONS

This application is a continuation application of International Application No. PCT/CN2021/126313, filed on Oct. 26, 2021, which claims priority to Chinese Patent Application No. 202110759322.4, filed on Jul. 6, 2021. The above-mentioned applications are incorporated herein by reference in their entireties.

TECHNICAL FIELD

The present application relates to the technical field of wrist-worn devices, and in particular to a wristband and a wrist-worn device.

BACKGROUND

With the development of electronic technology, wrist-worn devices are becoming more and more popular. A wrist-worn device generally includes a device body and a flexible wristband. The device body is used to display image information to the user, and the wristband is used to wear the device body on the user's wrist or ankle. In existing wrist-worn devices, since the flexible wristband has no supporting effect and positioning effect, a wristband buckle is generally provided on one wristband, and a plurality of positioning holes are provided on the other wristband. The wristband buckle and the positioning holes coordinate to connect the two wristbands, so that the wrist-worn device can be stably worn on the user's wrist. However, this way of wearing makes the user need to buckle or unbuckle the wristband buckle during the wearing and removing process of the wrist-worn device, which is inconvenient to operate and greatly affects the user's experience.

SUMMARY

A main purpose of the present application is to provide a wristband, aiming to allow the user to quickly and conveniently wear or remove a wrist-worn device on the wrist, thereby improving user's experience.

In order to achieve the above purpose, the wristband provided by the present application includes a band body part and a memory metal wire. The band body part has two end portions separable from each other. The memory metal wire has a strip shape extending along a length direction of the band body part and provided to the band body part. The memory metal wire has a memory state of being ring-shaped in a natural state, so that the band body part naturally maintains a ring shape, and the wristband naturally maintains a wearing state. A first installation cavity is provided inside the band body part, and the memory metal wire is accommodated and installed in the first installation cavity.

In some embodiments, the first installation cavity penetrates one end portion of the band body part, the wristband is further provided with a covering cap, and the covering cap is sleeved on the end portion of the band body part penetrated by the first installation cavity.

In some embodiments, an end portion of the memory metal wire is configured to be spherical or near-spherical; and/or an installation groove for accommodating the spherical or near-spherical end portion of the memory metal wire is formed on the covering cap.

In some embodiments, an inner surface of the first installation cavity and/or an outer surface of the memory metal wire is provided with a coating.

In some embodiments, the band body part has a first surface and a second surface opposite to the first surface, the wearing state includes a first wearing method with the first surface as an inner ring surface and a second wearing method with the second surface as the inner ring surface; and the band body part is capable of switching between the first wearing method and the second wearing method when subjected to a reverse force.

In some embodiments, the two end portions of the band body part are overlapped when in the wearing state, and at least one of two opposite surfaces of the overlapped two end portions is provided with protrusions.

In some embodiments, the wristband further includes an installation part provided to the band body part, a second installation cavity is provided inside the installation part, and the second installation cavity is configured to accommodate and install a device body of a wrist-worn device; and/or the installation part is further provided with an opening communicating with the second installation cavity.

In some embodiments, the installation part includes a fabric layer connected to the band body part and a first soft rubber film layer attached to the fabric layer, and the opening is a cut penetrating the first soft rubber film layer and the fabric layer in sequence.

In some embodiments, the band body part includes a fabric body and a second soft rubber film layer provided on an inner side of the fabric body; and/or the second soft rubber film layer is provided with ventilating holes.

The present application further provides a wrist-worn device, which includes a device body and the above-mentioned wristband, and the device body is provided on the wristband.

In some embodiments, the device body is a watch body or a health monitoring module.

In the technical solution of the present application, the band body part has two end portions separable from each other, the memory metal wire has a memory state of being ring-shaped in a natural state, so that the band body part naturally maintains a ring shape, and the wristband naturally maintains a wearing state. In this way, the wristband buckle and related connection structures can be saved, thereby saving material costs and assembly costs; furthermore, the user does not need to align the wristband buckle and the positioning holes and buckle them when wearing it, and the user does not need to unbuckle it to remove the wristband, which allows the user to conveniently and quickly wear and remove the wrist-worn device on the wrist, thereby improving the user's experience. In addition, a first installation cavity is provided inside the band body part, the memory metal wire is accommodated and installed in the first installation cavity, so that the band body part can provide a physical protection for the memory metal wire. Moreover, since the rotation of the memory metal wire inside the band body part is not restricted, which allows the band body part to switch between a first wearing method and a second wearing method when a reverse force is applied to the band body part, i.e., the wristband can be worn forwardly and reversely, thereby enriching the usage functions of a wrist-worn device that is provided with this wristband. For example, but not limited, for a device body that only has a display area on one side, when worn forwardly, the display area can be visible, and when worn reversely, the display area can be hidden to avoid leakage of display content; for a device body that has a detection probe on both the front and back sides, when worn forwardly, the detection probe on the back side can be attached to the skin for measurement, and when worn reversely, the detection probe on the front side can be attached to the skin for measurement. Meanwhile, the product can present different wearing styles by using different colors and/or patterns on two band surfaces.

BRIEF DESCRIPTION OF THE DRAWINGS

In order to more clearly illustrate the technical solutions in the embodiments of the present application or in the related art, the accompanying drawings that are needed to illustrate the embodiments and the related art are simply introduced below. Obviously, the accompanying drawings introduced below are just some of the embodiments in the present application. For those skilled in the art, other drawings can be further obtained without creative efforts according to the structures shown in these drawings.

The realization of purposes, functional features and advantages will be further illustrated in conjunction with the embodiments and with reference to the drawings.

DETAILED DESCRIPTION OF THE EMBODIMENTS

The technical solutions of the embodiments of the present application will be described in more detail below with reference to the accompanying drawings. It is obvious that the embodiments to be described are only some rather than all the embodiments of the present application. All other embodiments obtained by persons skilled in the art based on the embodiments of the present application without creative efforts should fall within the scope of the present application.

It should be noted that all the directional indications (such as up, down, left, right, front, rear, etc.) in the embodiments of the present application are only used to explain the relative positional relationship, movement, or the like of the components in a certain posture. If the posture changes, the directional indication will change accordingly.

Besides, the descriptions associated with, "first" and "second", etc. in the present application are merely for descriptive purposes, and cannot be understood as indicating or suggesting relative importance or implicitly indicating the number of the indicated technical feature. Therefore, the feature associated with "first" or "second" can expressly or implicitly include at least one such feature. Moreover, the meaning of "and/or" appearing in the present application includes three parallel scenarios. For example, "A and/or B" includes only A, or only B, or both A and B. In addition, the technical solutions of the various embodiments can be combined with each other, but the combinations must be based on the realization of those skilled in the art. When the combination of technical solutions is contradictory or cannot be achieved, it should be considered that such a combination of technical solutions does not exist, nor does it fall within the scope of the present application.

Figure 1:
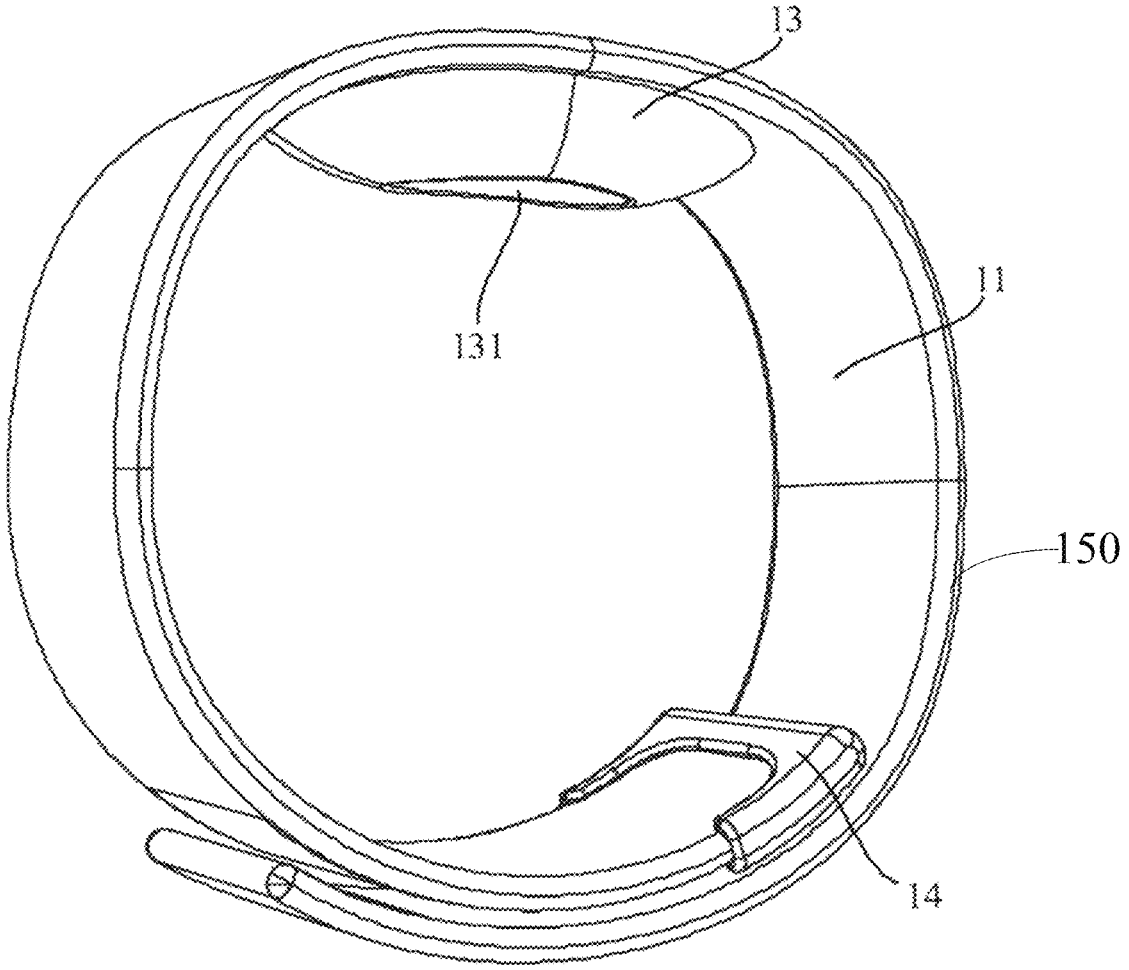
FIG. 1 is a schematic structural view of a wrist-worn device according to an embodiment of the present application.
Figure 2:
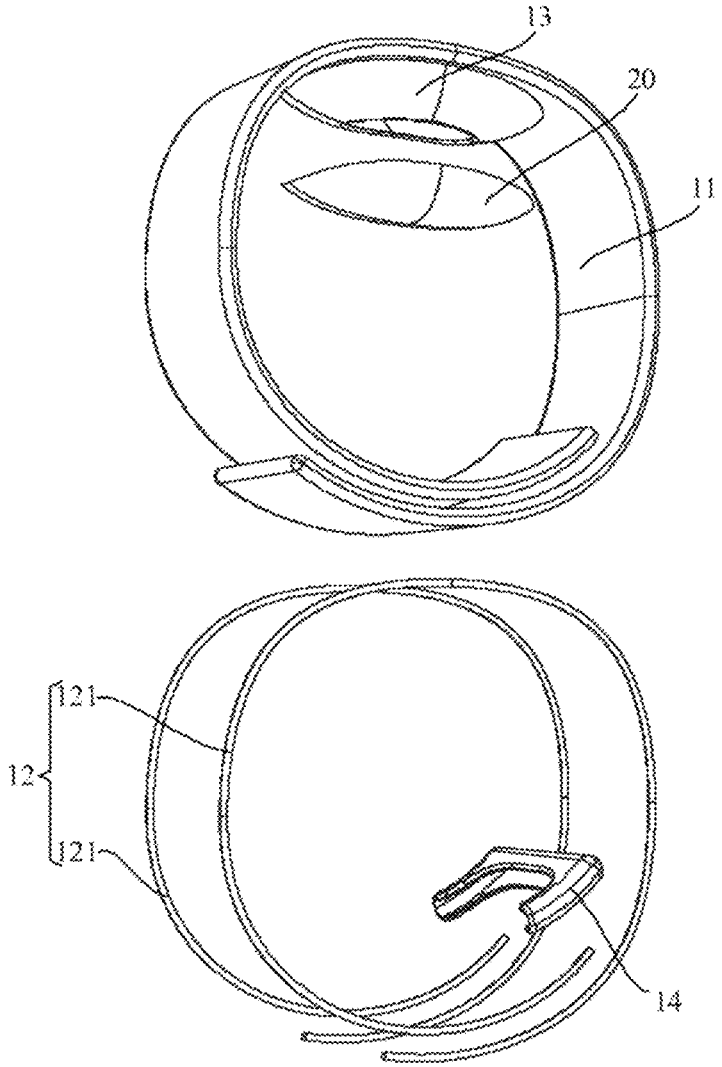
FIG. 2 is an exploded schematic structural view of the wrist-worn device in FIG. 1.

The present application provides a wrist-worn device. Referring to FIGS. 1 and 2, the wrist-worn device generally includes a wristband and a device body 20 provided on the wristband. The device body 20 can be a watch body (for example, it can be a regular watch body, a smart watch body, or a smart band body, etc.) or a heath monitoring module (generally refers to a watch body that does not have a display function, but provided with monitoring sensors which monitor users' heart rate, blood pressure, and so on, or provided with sensors which monitor exercise state, number of steps, etc., or the like). In the present application, the wristband has a ring-shaped wearing state, and the wearing state can be maintained by itself, i.e., even in a non-wearing state, the wristband can still maintain the ring-shaped state, which is different from a clap ring. Without loss of generality, the device body 20 is provided at the middle of the wristband; and in other embodiments, the device body 20 can also be slightly offset from the middle position. It should be noted that in some special situations, the wrist-worn device can only be a wristband and is not provided with a device body 20, for example, it can be a decorative wristband.

It should be noted that the ring-shaped wearing state of the wristband in the present application means that, the wristband has only one shape in its natural state, that is, it can only naturally maintain a ring shape, which is different from the clap ring. The clap ring can have two shapes in its natural state, one is a straight bar shape, and the other is an arc (ring) shape. The straight bar-shaped clap ring can change into the arc (ring) shape after being slapped on the wrist to be worn. It should be further noted that the wristband in the present application "can only naturally maintain a ring shape" does not intend to limit the deformation ability of the wristband. At least, when under the action of an external force, two end portions of the wristband can deform and open outwards, so that the user can wear or remove the wrist-worn device on the wrist; and when the external force disappears, the wristband can recover its shape to the arc-shaped wearing state.

Referring to FIGS. 1 and 2, in an embodiment of the present application, the wristband includes a band body part 11 and a memory metal part 12 provided on the band body part 11. The band body part 11 has two end portions that can be separated from each other, the memory metal part 12 has a memory state of being ring-shaped in its natural state, so that the band body part 11 can naturally maintain a ring shape, and the wristband can naturally maintain in the wearing state. In this way, the wristband buckle and related connection structures can be saved, thereby saving material costs and assembly costs; furthermore, the user does not need to align the wristband buckle and the positioning holes and buckle them when wearing it, and the user does not need to unbuckle it to remove the wristband, which allows the user to conveniently and quickly wear and remove the wrist-worn device on the wrist, thereby improving the user's experience.

It can be understood that the memory metal has superelasticity, which is manifested as having much greater deformation recovery ability than ordinary metals under the action of external force, that is, the large strain generated during the loading process (such as the wearing/removing process) will be eliminated with unloading, and then the memory metal part 12 recovers to a (ring-shaped) memory shape.

In an embodiment, there is a gap between the two end portions of the band body part 11 in the wearing state. However, the present application is not limited to this. In other embodiments, the two end portions of the band body part 11 are overlapped (see FIG. 1) in the wearing state; in other embodiments, the two end portions of the band body part 11 are staggered in parallel in the wearing state; and in other embodiments, the two end portions of the band body part 11 are abutted jointed in the wearing state.

Figure 5:
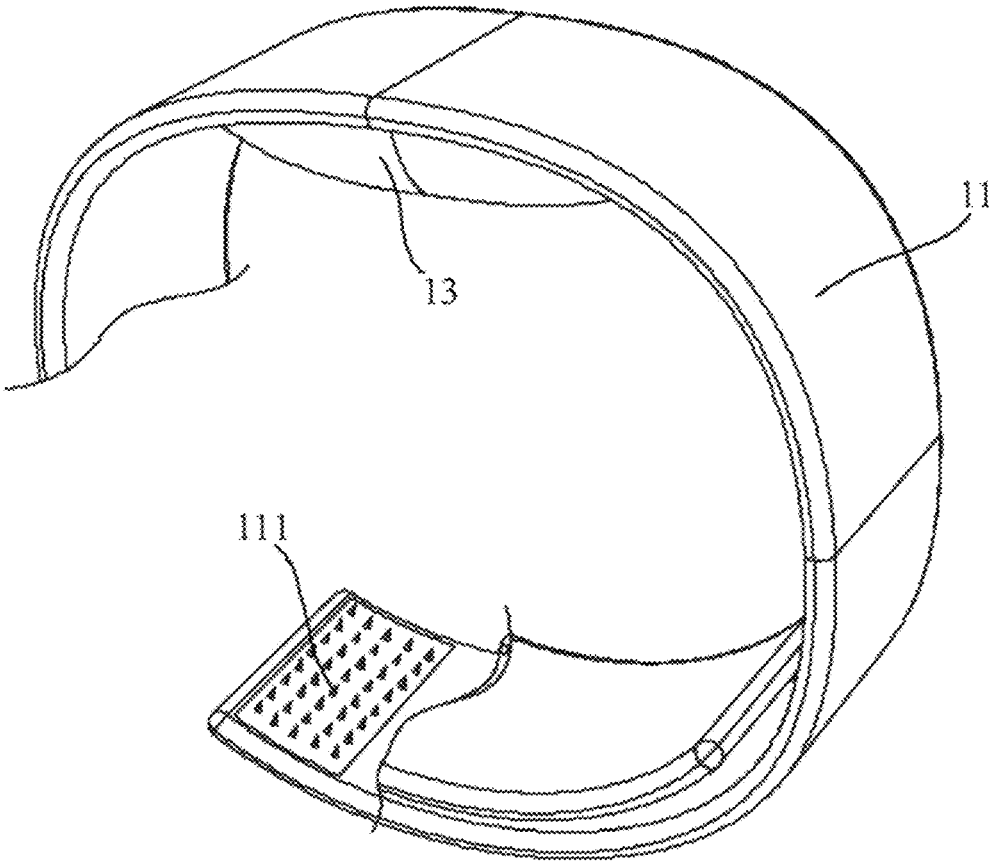
FIG. 5 is a schematic structural view showing protrusions on a band body part of the wristband according to an embodiment of the present application.

In an embodiment, referring to FIG. 5, when the two end portions of the band body part 11 are overlapped, at least one of two opposite surfaces of the overlapped two end portions is provided with protrusions 111. These protrusions 111 can be flat dot-shaped, and can also be thorn-shaped or barb-shaped. It can be understood that, by providing the protrusions 111, the frictional force between the two opposite surfaces of the overlapped two end portions is increased, the probability of displacement along the length direction of the band body part 11 occurring between the overlapped two end portions is reduced, and the wearing stability of the wristband is therefore improved. Specifically, since what is increased is the frictional force between the two opposite surfaces when they slide and displace, and the connection force between the overlapped two end portions in a direction perpendicular to an outer surface of the band body part 11 cannot be increased (the existing Velcro tape mainly increases the connection force). That is, when the two end portions of the band body part 11 are pulled outward (the force is almost perpendicular to the outer surface of the band body part 11) to wear or remove the wristband, the protrusions 111 will not cause any obstruction, thereby not bringing extra labor to the wearing and removing of the wristband.

Especially for the thorn-shaped or barb-shaped protrusions 111, the protrusions 111 are preferably soft rubber protrusions. During the wearing process, as the user vigorously shakes wrist, a vertical squeezing force and a horizontal relative displacement inertia will be generated between the overlapped two end portions of the wristband. The vertical squeezing force will cause the soft rubber protrusions to be squeezed in the vertical direction, and the horizontal relative displacement inertia will cause the soft rubber protrusions to be stretched in the horizontal direction, thereby increasing the contact area between the soft rubber protrusions and the opposite side wristband and/or another group of soft rubber protrusions on the opposite side wristband, increasing the frictional force between the overlapped two end portions of the wristband, and preventing the overlapped two end portions of the wristband from being staggered and avoiding the wristband from slipping from the wrist. In an embodiment, two opposite surfaces of the overlapped two end portions are both provided with soft rubber protrusions, during the shaking process when wearing the wristband on the wrist, the vertical squeezing force and the horizontal relative displacement inertia cause the two groups of soft rubber protrusions to be squeezed and deformed, so that they are twisted and conglutinated together, making the wearing of the wristband more stable and reliable. Therefore, the wristband of the present application does not need the assistance of a wristband buckle and does not need to worry about the problem of slipping.

In other embodiments of the present application, for the dot-shaped protrusions 111, soft rubber or hard rubber can also be used.

Therefore, the memory metal part 12 of the present application can realize a stable support and wearing for a wrist-worn device on the user's wrist without a wristband buckle. The protrusions 111 on the end portion of the band body part 11 can prevent the two end portions of the band body part 11 from being staggered, thereby preventing the ring size of the wristband from becoming large and slipping from the wrist, and further increasing the wearing stability. In addition, by providing the memory metal part 12 and the protrusions 111, a buckling operation in the wearing process and an unbuckling operation in the removing process of the conventional wrist-worn device is avoided, which makes the wearing and removing process more convenient.

In an embodiment, a first installation cavity 150 is provided inside the band body part 11, and the memory metal part 12 is accommodated and installed in the first installation cavity 150, that is, the memory metal part 12 is provided inside the band body part 11, to provide a physical protection for the memory metal part 12 through the band body part 11.

Figure 3A:
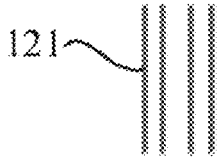
FIGS. 3*a*-3*e* are schematic structural views showing various memory metal parts of the wristband on a matrix phase plane according to the present application.
Figure 3B:
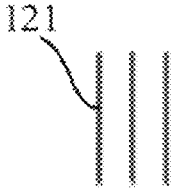
Figure 3C:
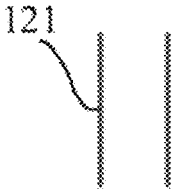
Figure 3D:
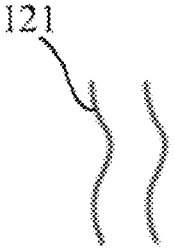
Figure 3E:
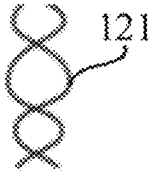

In an embodiment, the memory metal part 12 includes a memory metal wire 121 and/or a memory metal sheet. To save materials, the memory metal part 12 typically uses a memory metal wire 121 or a narrow memory metal sheet. Referring to FIG. 3*a*, FIG. 3*b*, and FIG. 3*c*, in an embodiment, the memory metal part 12 includes multiple elongated memory metal pieces (wire-shaped or narrow sheet-shaped) that are parallel to each other. The memory metal pieces are in a strip shape extending along the length direction of the band body part 11, and at least two of the memory metal pieces are configured to be respectively close to the two opposite sides of the band body part 11. In another embodiment, the memory metal part 12 includes an elongated memory metal piece (wire-shaped or narrow sheet-shaped), the memory metal piece is continuously bent within the matrix phase plane and has multiple bent portions and then bent into a ring shape with one side of the matrix phase plane as an inner side. Referring to FIG. 3*d*, in yet another embodiment, the memory metal part 12 includes two elongated memory metal pieces (wire-shaped or narrow sheet-shaped), each memory metal piece has at least one bent portion in the matrix phase plane, and is then bent into a ring shape with one side of the matrix phase plane as the inner side. The bent portions of the two memory metal pieces do not intersect. Referring to FIG. 3*e*, in another embodiment, the memory metal part 12 includes two elongated memory metal pieces (wire-shaped or narrow sheet-shaped), each memory metal piece is continuously bent in the matrix phase plane and has multiple bent portions and then bent into a ring shape with one side of the matrix phase plane as the inner side, and the bent portions of the two memory metal pieces intersect.

In an embodiment, referring to FIGS. 1 and 2, the first installation cavity 150 penetrates one end portion of the band body part 11, and a covering cap 14 is provided to the wristband. The covering cap 14 is sleeved on the end portion of the band body part 11 penetrated by the first installation cavity 150. It can be understood that the other end portion of the band body part 11 can be closed, that is, the first installation cavity 150 does not penetrate the other end portion of the band body part 11. In this way, only one covering cap 14 is needed. In this embodiment, by providing the covering cap 14, the memory metal part 12 is prevented from being exposed and falling out. in an embodiment, the material of the covering cap 14 can be soft rubber, hard rubber, or metal, etc. In an embodiment, the connection method between the covering cap 14 and the band body part 11 can be, but is not limited to, thermal pressure connection, adhesive connection, etc.

In an embodiment, when the memory metal part 12 is a memory metal wire 121, the end portions of the memory metal wire 121 are configured to be spherical or near-spherical, to reduce the sharpness of the end portions of the memory metal wire 121 and reduce the probability of the end portions of the memory metal wire 121 piercing out of the band body part 11. It can be understood that the spherical or near-spherical structure of the end portions of the memory metal wire 121 is configured to be thickened, that is, the diameter of the spherical or near-spherical structure is greater than the diameter of the memory metal wire 121.

Figure 4:
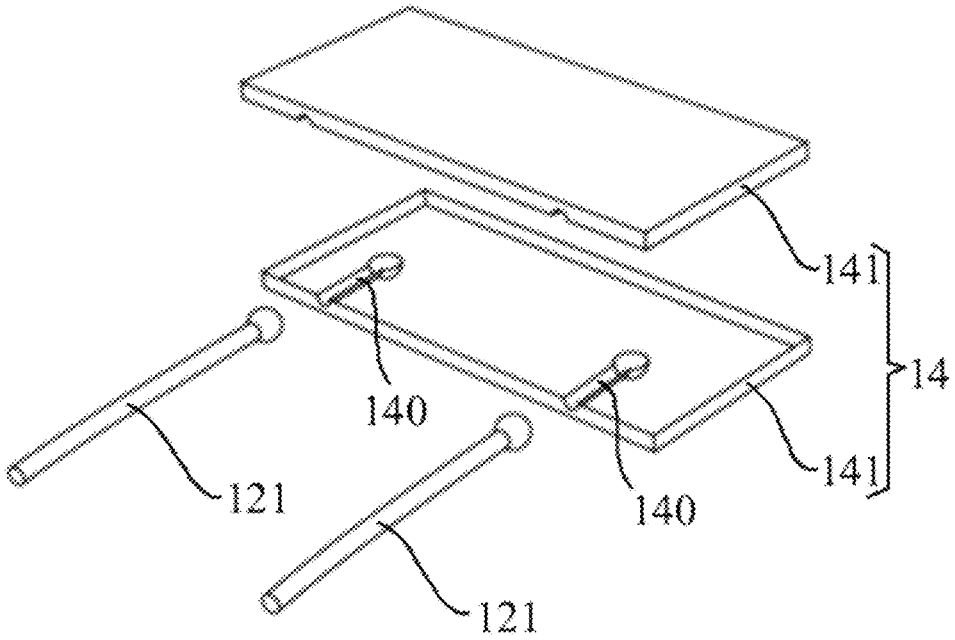
FIG. 4 is a schematic structural view of the memory metal wires and the covering cap of the wristband according to an embodiment of the present application.

In an embodiment, an accommodation groove 140 for fitting and accommodating the spherical or near-spherical end portion of the memory metal wire 121 is formed on the covering cap 14, to prevent the end portion of the memory metal wire 121 from leaving the covering cap 14 and reduce the sliding of the memory metal wire 121 relative to the first installation cavity 150. In an embodiment, referring to FIG. 4, the covering cap 14 is in the shape of a clip, and includes two clipping parts 141 opposite to each other. Each clipping part 141 has half an installation groove 140 on the surface facing the other clipping part 141.

In an embodiment, referring to FIGS. 1 and 2, the wristband further includes an installation part 13 provided on the band body part 11. The installation part 13 is used for the installation of the device body 20, to facilitate the connection between the device body 20 and the wristband. In an embodiment, a second installation cavity is provided inside the installation part 13 and used for accommodating and installing the device body 20, to improve the stability and reliability of the installation of the device body 20. In an embodiment, the installation part 13 is provided with an opening 131 communicating with the second installation cavity. The opening 131 can not only allow the device body 20 to pass through for assembly and disassembly, but also make the display area visible when the device body 20 has a display area, and can also allow the detection probe to extend out when the device body 20 has a detection probe.

In an embodiment, the installation part 13 includes a fabric layer connected to the band body part 11 and a first soft rubber film layer attached to the fabric layer. The opening 131 is a cut that penetrates the first soft rubber film layer and the fabric layer in sequence. It can be understood that the setting of the first soft rubber film layer can harden the fabric layer, thereby facilitating the cutting and processing of the opening 131, especially it can avoid a phenomenon of fabric drawing during cutting. In this embodiment, generally, the material of the band body part 11 also uses fabric, so that the band body part 11 and the fabric layer of the installation part 13 can be woven at the same time, which is convenient for processing.

In the aforementioned embodiment, the material of the band body part 11 usually uses fabric; however, the present application is not limited to this. In other embodiments, in addition to fabric, the material of the band body part 11 can also use soft rubber and/or hard rubber, etc. It should be noted that in addition to being made of a single fabric or a single soft rubber or a single hard rubber (especially when the material of the band body part 11 uses a single hard rubber, the band body part 11 is in the shape of a long stripe as a whole and has sufficient flexibility to bend), the band body part 11 can also be made of two or more materials together. For example, the band body part 11 can include a band-shaped fabric body and a soft rubber edge covering the edge of the fabric body. The fabric body has good breathability, the soft rubber edge can provide a good shaping effect, and prevent the edge of the fabric body from loosing stitching and reduce the dirt on the edge of the band body part 11 (compared with the fabric, the soft rubber is not easy to get dirty, and even if it is dirty, it is easy to scrub). In an embodiment, the inner side of the fabric body can also be provided with a second soft rubber film layer, to isolate sweat, etc. through the second soft rubber film layer and reduce the probability of the fabric body being dirtied by sweat or the like. In an embodiment, ventilating holes are provided on the second soft rubber film layer, which is beneficial to ensure the good breathability of the band body part 11.

Figure 7:
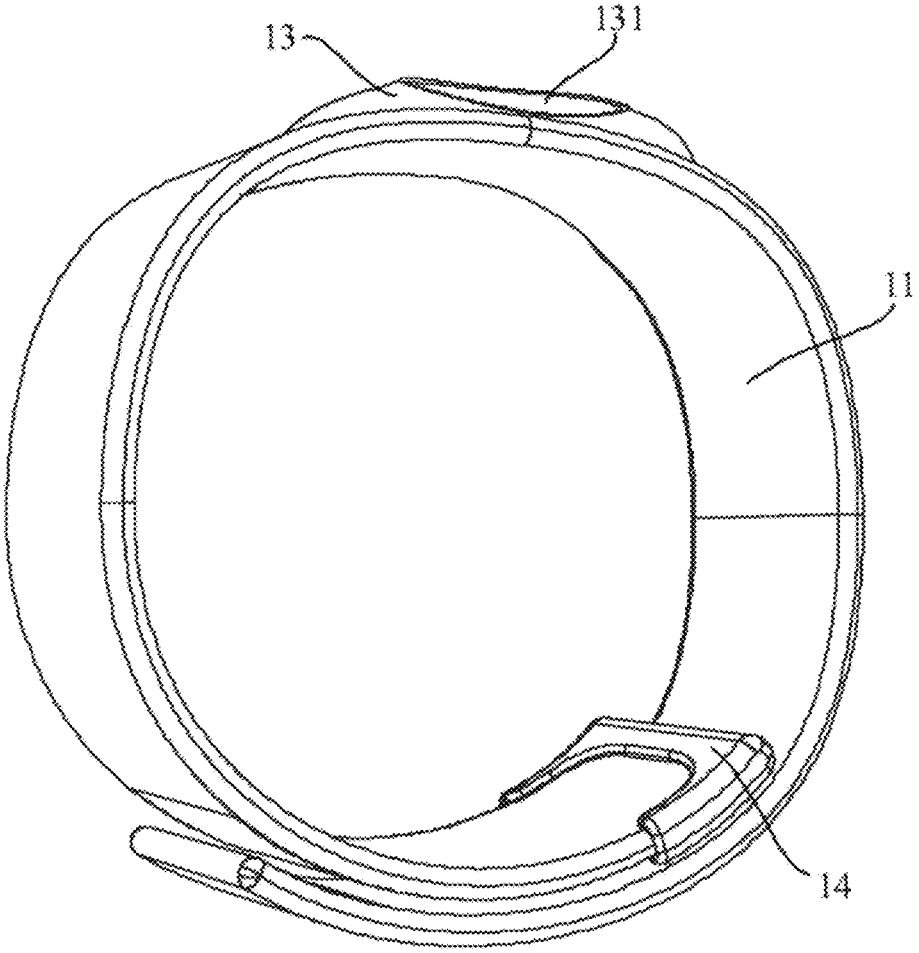
FIG. 7 is a schematic structural view of a wrist-worn device according to another embodiment of the present application.

In an embodiment, the band body part 11 has a first band surface and a second band surface opposite to the first band surface. The wearing state includes a first wearing method with the first band surface as an inner ring surface (see FIG. 1) and a second wearing method with the second band surface as the inner ring surface (see FIG. 7). The memory metal part 12 is a strip-shaped memory metal wire 121 extending along the length direction of the band body part 11. The memory metal wire 121 is provided inside the band body part 11, so that the band body part 11 can switch between the first wearing method and the second wearing method. In this way, different design styles (such as different colors, patterns, etc.) can be used on the first band surface and the second band surface, and the product of the present application can present two wearing styles by being worn forwardly or reversely.

It can be understood that the memory metal wire 121 does not adhere to the inner surface of the first installation cavity 150. In this way, when a reverse force (defined as a force applied in the opposite direction to the bending direction of the band body part 11) is applied to the band body part 11/memory metal part 12, the memory metal wire 121 is driven by external force and can freely rotate without being restricted by the band body part 11. In this way, when the band body part 11 is in the first wearing method, the user can turn the band body part 11 backwards, and the memory metal wire 121 freely rotates in the first installation cavity 150 under the action of the turning force, so that the band body part 11 can switch to the second wearing method; and vice versa.

It should be noted that in the aforementioned embodiment where the covering cap 14 is provided, the covering cap 14 not only has a protection function. Since the covering cap 14 is sleeved on the end portion of the memory metal wire 121, the spherical or near-spherical end portion of the memory metal wire 121 and the inner surface of the installation groove 140 on the covering cap 14 are therefore also not adhesive, which further ensures that when an external force is applied to the band body part 11/memory metal part 12, the memory metal wire 121 is driven by the external force and can freely rotate without restriction, to ensure the band body part 11 can be turned backwards.

In other embodiments of the present application, the covering cap 14 may not be provided, as long as the end portion of the memory metal wire 121 is not fixed and ensuring that the memory metal wire 121 can freely rotate without restriction.

The wristband provided by the embodiments can be worn on both sides, which can enrich the usage functions of the wrist-worn device that is provided with this wristband. For example, but not limited to, for a device body 20 that only has a display area on one side, when worn forwardly, the display area can be visible, and when worn reversely, the display area can be hidden to avoid leakage of display content; for a device body 20 that has a detection probe on both the front and back sides, when worn forwardly, the detection probe on the back side can be attached to the skin for measurement, and when worn reversely, the detection probe on the front side can be attached to the skin for measurement.

In an embodiment, the inner surface of the first installation cavity 150 and/or the outer surface of the memory metal wire 121 are/is provided with coatings. In an embodiment, the coating provided on the outer surface of the memory metal wire 121 can be arranged as a smooth coating, such as, but not limited to Teflon coating, nano-ceramic coating, or tungsten carbide coating, etc. In this way, on the one hand, the surface of the memory metal wire 121 is smooth, which is beneficial for its free rotation, and will not scratch the inner wall of the band body part 11 when switching between two wearing methods, so that the service life of the band body part 11 is prolonged. On the other hand, corrosion of the memory metal wire 121 can be avoided and the service life of the memory metal wire 121 can be prolonged. In an embodiment, the coating on the inner surface of the first installation cavity 150 is also arranged as a smooth coating, which facilitates the smooth insertion of the memory metal wire 121 and improves the assembly efficiency.

In an embodiment, the first installation cavity 150 and the second installation cavity are communicated; there are two memory metal wires 121; the device body 20 is provided with two positioning slots 21 arranged in the width direction of the band body part 11 with interval, and the two memory metal wires 121 are installed in the two positioning slots 21 correspondingly, to avoid the two memory metal wires 121 from approaching each other in the width direction of the band body part 11 during use, thereby ensuring that the two memory metal wires 121 can provide support for the opposite sides of the band body part 11, especially when the material of the band body part 11 uses fabric. It can be understood that the fabric needs more support compared to soft rubber and hard rubber.

It should be noted that in the aforementioned embodiment where the covering cap 14 is provided, the covering cap 14 can also be provided with two installation grooves 140 arranged in the width direction of the band body part 11 with interval, to separately accommodate the spherical or near-spherical end portions of the two memory metal wires 121.

Figure 6A:
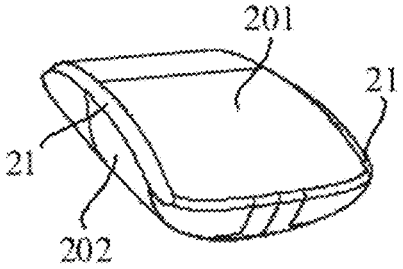
FIGS. 6*a*-6*c* are schematic structural views showing various device bodies of the wrist-worn device according to the present application.
Figure 6B:
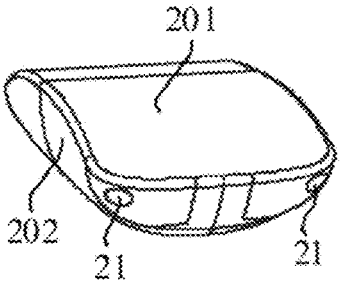
Figure 6C:
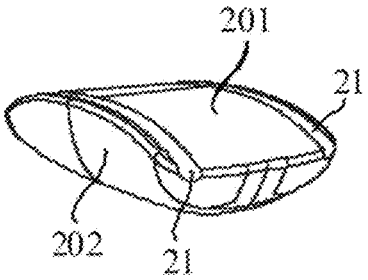

Without loss of generality, the device body 20 has a first main surface 201 and a second main surface opposite to the first main surface 201, and a first side surface 202 and a second side surface opposite to the first side surface 202. The first main surface 201 or the second main surface is an inner side surface in the wearing state. In an embodiment, referring to FIG. 6*b*, the two positioning slots 21 are both hole-shaped slots that penetrate the device body 20 along the length direction of the band body part 11, and arranged corresponding to the first side surface 202 and the second side surface, respectively. However, the present application is not limited to this. Referring to FIG. 6*c*, in another embodiment, the two positioning slots 21 can also be respectively recessed on two opposite sides of the first main surface 201; and in yet another embodiment, the two positioning slots 21 can also be respectively recessed on two opposite sides of the second main surface; and in another embodiment, the two positioning slots 21 can also be respectively recessed on the first side surface 202 and the second side surface. For example, referring to FIG. 6*a*, one of the positioning slots 21 is recessed at a corner of the first side surface 202 close to the first main surface 201, and the other positioning slot 21 is recessed at a corner of the second side surface close to the first main surface 201.

The above-mentioned are only preferred embodiments of the present application, and are not intended to limit the scope of the present application. Under the inventive concept of the present application, any equivalent structural transformation made by using the contents of the description and drawings of the present application, or direct/indirect application in other related technical fields, are included in the scope of the present application.

What is claimed is:

1. A wristband, comprising:

a band body part having two end portions separable from each other; and a memory metal wire having a strip shape extending along a length direction of the band body part and provided to the band body part, wherein the memory metal wire has a memory state of being ring-shaped in a natural state, so that the band body part naturally maintains a ring shape, and the wristband naturally maintains a wearing state; and a first installation cavity is provided inside the band body part, and the memory metal wire is accommodated and installed in the first installation cavity, wherein the band body part has a first surface and a second surface opposite to the first surface, the wearing state comprises a first wearing method with the first surface as an inner ring surface and a second wearing method with the second surface as the inner ring surface, and the band body part is capable of switching between the first wearing method and the second wearing method when subjected to a reverse force.

2. The wristband of claim 1, wherein the first installation cavity penetrates an end portion of the band body part, the wristband is further provided with a covering cap, and the covering cap is sleeved on the end portion of the band body part penetrated by the first installation cavity.

3. The wristband of claim 2, wherein an end portion of the memory metal wire is configured to be spherical or near spherical; and/or an installation groove for accommodating the spherical or near-spherical end portion of the memory metal wire is formed on the covering cap.

4. The wristband of claim 1, wherein an inner surface of the first installation cavity and/or an outer surface of the memory metal wire is provided with a coating.

5. The wristband of claim 1, wherein the two end portions of the band body part are overlapped when in the wearing state, and at least one of two opposite surfaces of the overlapped two end portions is provided with protrusions.

6. The wristband of claim 1, further comprising an installation part provided to the band body part, wherein a second installation cavity is provided inside the installation part, and the second installation cavity is configured to accommodate and install a device body of a wrist-worn device; and/or the installation part is further provided with an opening communicating with the second installation cavity.

7. A wrist-worn device, comprising:

a device body; and the wristband of claim 1, wherein the device body is provided on the wristband.

8. The wrist-worn device of claim 7, wherein the device body is a watch body or a health monitoring module.

* * * * *